US006681735B2

(12) United States Patent
Ishihara

(10) Patent No.: US 6,681,735 B2
(45) Date of Patent: Jan. 27, 2004

(54) SLIDING MEMBER AND METHOD OF MANUFACTURING THEREOF

(75) Inventor: Motokata Ishihara, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/111,604

(22) PCT Filed: Aug. 13, 2001

(86) PCT No.: PCT/JP01/07000

§ 371 (c)(1),
(2), (4) Date: Apr. 26, 2002

(87) PCT Pub. No.: WO02/25068

PCT Pub. Date: Mar. 28, 2002

(65) Prior Publication Data

US 2002/0162523 A1 Nov. 7, 2002

(30) Foreign Application Priority Data

Sep. 21, 2000 (JP) ..... 2000-286497

(51) Int. Cl.[7] ..... F01L 1/14
(52) U.S. Cl. ..... 123/90.51; 29/898
(58) Field of Search ..... 384/912, 913, 384/625; 29/898; 123/90.51

(56) References Cited

U.S. PATENT DOCUMENTS

| | | | | |
|---|---|---|---|---|
| 5,743,224 A | * | 4/1998 | Hosaka et al. | 123/90.51 |
| 6,095,693 A | * | 8/2000 | Fujiwara | 384/625 |
| 6,290,398 B1 | * | 9/2001 | Fujiwara et al. | 384/625 |
| 6,315,455 B1 | * | 11/2001 | Tanaka et al. | 384/492 |

FOREIGN PATENT DOCUMENTS

| | | |
|---|---|---|
| GB | 2155588 A | 9/1985 |
| JP | 4121404 A | 4/1992 |
| JP | 8134700 A | 5/1996 |
| JP | 10030726 A | 2/1998 |

* cited by examiner

*Primary Examiner*—Thomas Denion
*Assistant Examiner*—Jaime Corrigan
(74) *Attorney, Agent, or Firm*—Shinjyu Global IP Counselors, LLP.

(57) ABSTRACT

A sliding member (12) is disclosed that has superior slidability and durability at a low cost. A top sliding surface (12*a*) of the sliding member (12) is formed by a nitriding process that creates a compound layer (14) and a diffusion layer (15) on a base metal (16) of the sliding member (12). The buff polishing process is thinly performed on an outermost layer portion (14*a*) of the compound layer (14), such that a portion of the compound layer (14*b* and/or 14*c*) remains.

13 Claims, 3 Drawing Sheets

SLIDING MEMBER AND METHOD OF MANUFACTURING THEREOF

This application is the national phase under 35 U.S.C. §371 of International Application No. PCT/JP01/07000, which was filed on Aug. 13, 2001 and published in English on Mar. 28, 2002.

BACKGROUND OF THE INVENTION

1. Technical Field

The present invention generally relates to a sliding member such as valve lifter in an internal combustion engine, and a method of manufacturing a sliding member.

2. Description of Related Art

Japanese Laid-Open Utility Model Publication H4-121404 discloses a valve lifter having a shim that slideably contacts a cam for driving an intake/exhaust valve of an internal combustion engine. The shim of the valve lifter needs to have a sliding surface whose surface roughness is sufficiently small to minimize friction. At the same time, the sliding surface has to have a sufficient hardness in order to prevent excessive wear in the sliding surface, and also to prevent an increase in friction due to the increase in surface roughness of the sliding surface from the wear.

Therefore, it has been known to smooth the base metal of the sliding member, such as a valve lifter, with high precision through a lapping process, and thereafter to create a hard material protection coating such as a titanium nitride through physical vapor deposition (PVD) on its top sliding surface.

There exists a need for a sliding member that has low friction and superior durability at a low cost in comparison of the above mentioned prior art. This invention addresses this need in the prior art as well as other needs, which will become apparent to those skilled in the art from this disclosure.

SUMMARY OF THE INVENTION

It has been discovered that when a hard material coating is created on a sliding surface through physical vapor deposition, it is necessary to perform the process using a vacuum furnace. Accordingly, only a limited number of pieces can be processed at a time. Therefore, manufacturing cost of the sliding member or cam follower becomes very expensive. The present invention has been conceived in view of the aforementioned problem.

One of the objects of the present invention is to provide a sliding member that has low friction and superior durability at a low cost.

In accordance with one aspect of the present invention, a sliding member is produced that comprises a base metal, a diffusion layer, and a compound layer. The diffusion layer has a first predetermined depth and overlies the base metal. The compound layer has a second predetermined depth and overlies the diffusion layer. The diffusion layer and the compound layer are formed on the base metal through a nitriding process. The second predetermined depth of the compound layer is formed by a polishing process on an outermost layer portion of the compound layer such that an original depth of the compound layer formed by the nitriding process is reduced in depth to the second predetermined depth of the compound layer so that a smooth top sliding surface remains.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following description of the embodiments of the present invention is provided for illustration only, and not for the purpose of limiting the invention as defined by the appended claims and their equivalents.

Figure 1:
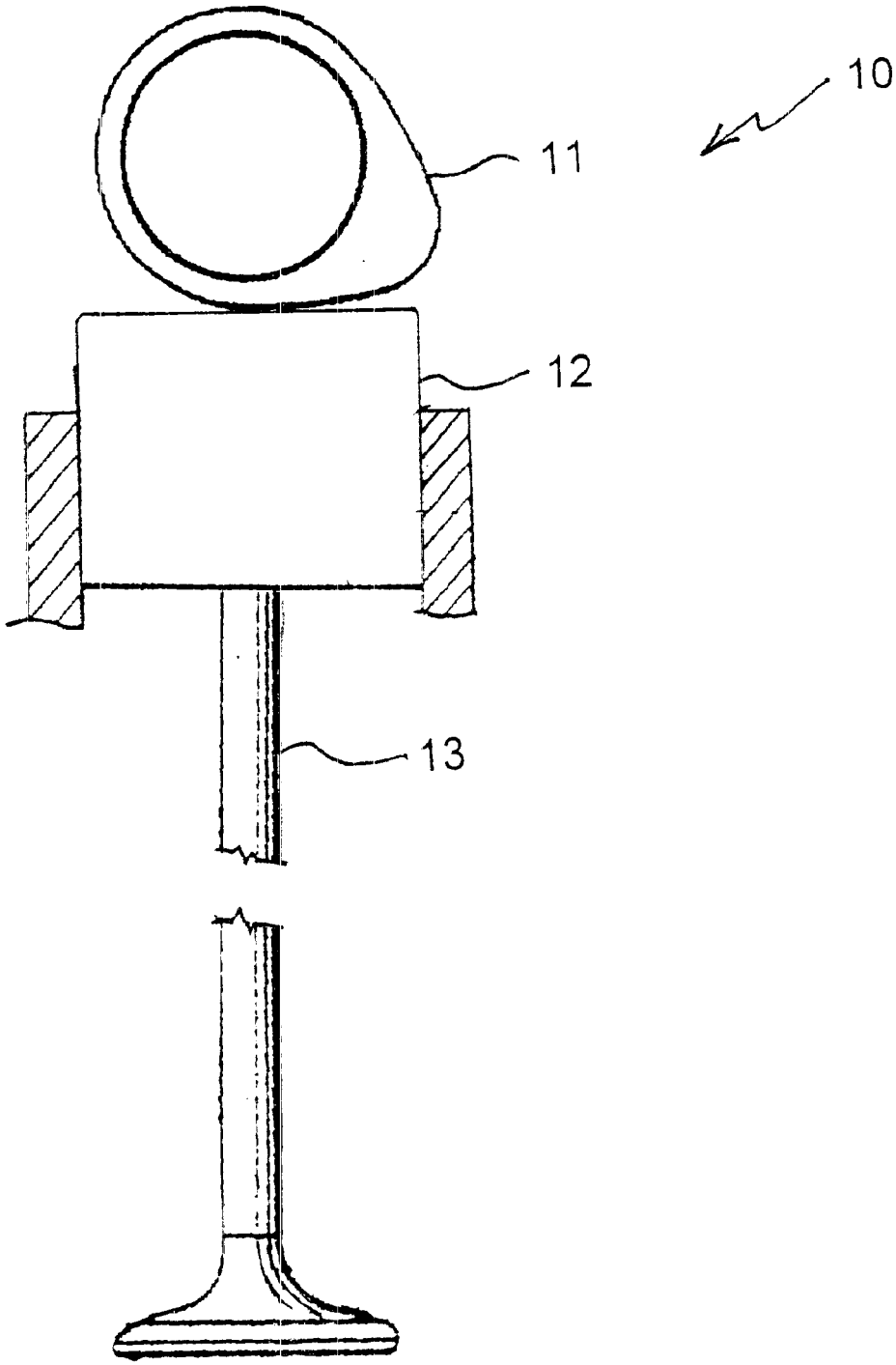
FIG. 1 is a partial diagrammatic view of a valve actuator assembly for an internal combustion engine having a valve lifter (sliding member) manufactured in accordance with one embodiment of the present invention.

Referring initially to FIG. 1, a portion of a valve actuator assembly 10 for an internal combustion engine (not shown) is diagrammatically illustrated to explain a first embodiment of the present invention. The valve actuator assembly 10 includes a cam 11 of a camshaft operatively contacting a cam follower (sliding member) in the form of a valve lifter 12 that moves an intake/exhaust valve 13.

Figure 2:
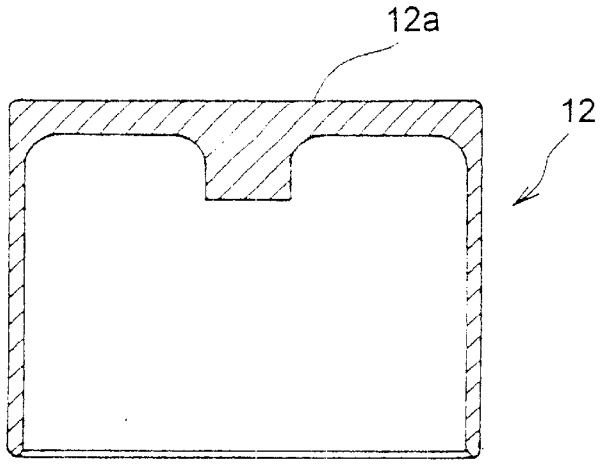
FIG. 2 is a cross sectional view of a valve lifter (sliding member) manufactured in accordance with one embodiment of the present invention.

As seen in FIG. 2, the valve lifter 12 as a finished product has a cylindrical shape with an open bottom. The valve lifter 12 is coupled to the intake/exhaust valve 13 in a conventional manner. The valve lifter 12 is placed in between the intake/exhaust valve 13 and the cam 11 of the camshaft that rotates together with a crankshaft (not shown). The valve lifter 12 has a top sliding surface 12*a* functioning as a cam sliding surface that slideably contacts the cam 11 of the camshaft. A surface finishing process is performed on this top sliding surface 12*a* as described below.

Figure 3:
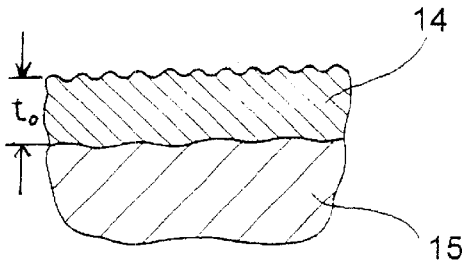
FIG. 3 is an enlarged partial cross sectional view of a selected portion of the valve lifter before a buff polishing process has been performed on the top sliding surface of the valve lifter.
Figure 4:
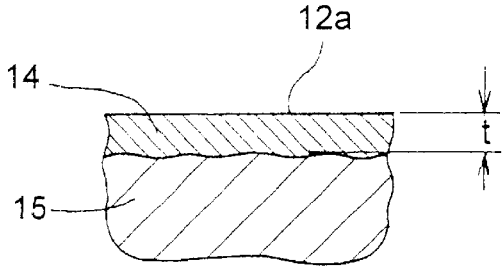
FIG. 4 is an enlarged partial cross sectional view of a selected portion of the valve lifter after a buff polishing process has been performed on the top sliding surface of the valve lifter.
Figure 5:
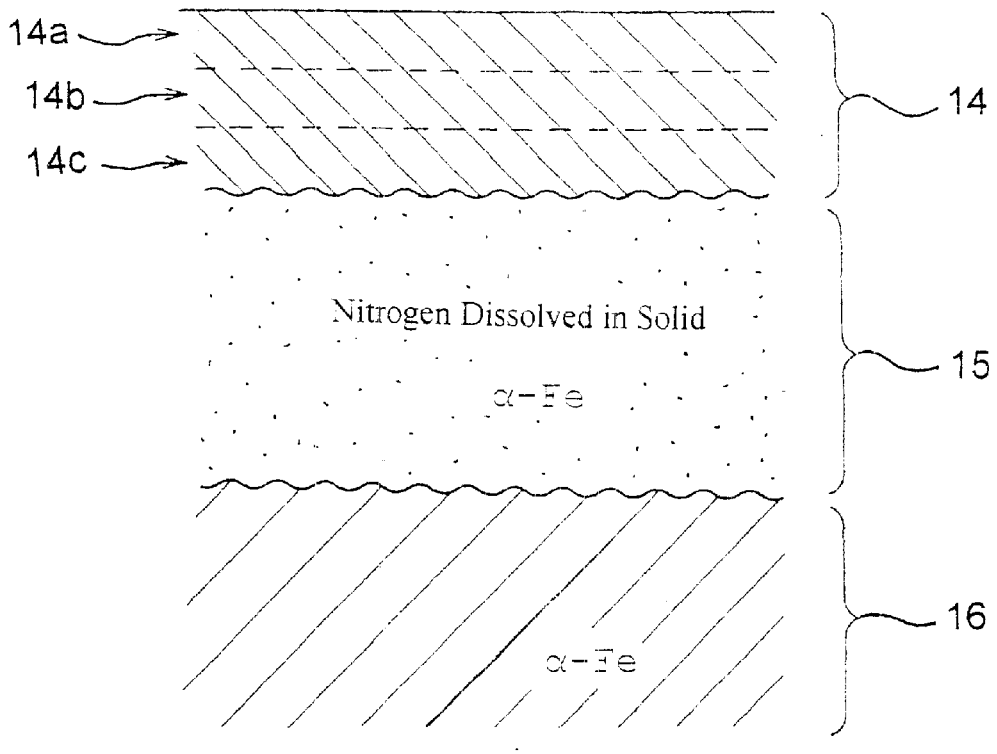
FIG. 5 an enlarged partial cross sectional view of a selected portion of the valve lifter that illustrates the diffusion layer and the compound layer created by the gas nitrocarburizing process performed on the top sliding surface of the valve lifter.

As seen in FIGS. 3 and 5 the sliding member or valve lifter 12 manufactured according to the present invention includes a top sliding surface 12*a* formed of a compound layer 14 and a diffusion layer 15 overlying the base metal 16. In particular, the top sliding surface 12*a* is preferably formed by a nitriding process on the base metal 16 of the valve lifter 12. The compound layer 14 and the diffusion layer 15 have original predetermined depths that are initially created by the nitriding process on the base metal 16 of the valve lifter 12. The original predetermined depth of the compound layer 14 is indicated as "$t_o$" in FIG. 3. After performing the nitriding process on the base metal 16, a polishing process is thinly performed on an outermost layer portion 14*a* of the compound layer 14, such that only layer portions 14*b* and 14*c* of the compound layer 14 remains. In other words, the outermost layer portion 14*a* of the compound layer 14 is completely removed by the polishing process. Accordingly, the original depth "$t_o$" of the compound layer 14 (FIG. 3) formed by the nitriding process is reduced in depth to the finished predetermined depth "t" of the compound layer 14 (FIG. 4) so that the smooth sliding surface 12*a* remains. Thus, the top sliding surface 12*a* is formed by thinly polished the compound layer 14 in a manner that conforms to the contour of the top sliding surface 12*a* so that a uniform finish is obtained.

The above-described nitriding process is a method by which nitrogen is diffused onto the base metal 16, thereby hardening the outer surface. Some of the nitriding processes contemplated by the present invention include pure nitriding in which only nitrogen is permeated, and nitrocarburizing in which nitrogen and carbon are permeated at the same time. More specifically, gas nitriding with ammonia gas, salt bath nitriding using salt bath with cyanide salt and cyanic acid type salt bath, liquid nitriding using cyanic acid, gas nitrocarburizing using ammonia gas and carburizing gas, and ion nitriding in which ionized nitrogen collides into the base metal at a high speed. In particular, gas nitrocarburizing is a pollution free processing method since it does not produce cyan. Also, gas nitrocarburizing can be processed in a stable and continuous manner. Accordingly, manufacturing cost can be kept low. Therefore, gas nitrocarburizing is well suited for the present invention.

Figure 6:
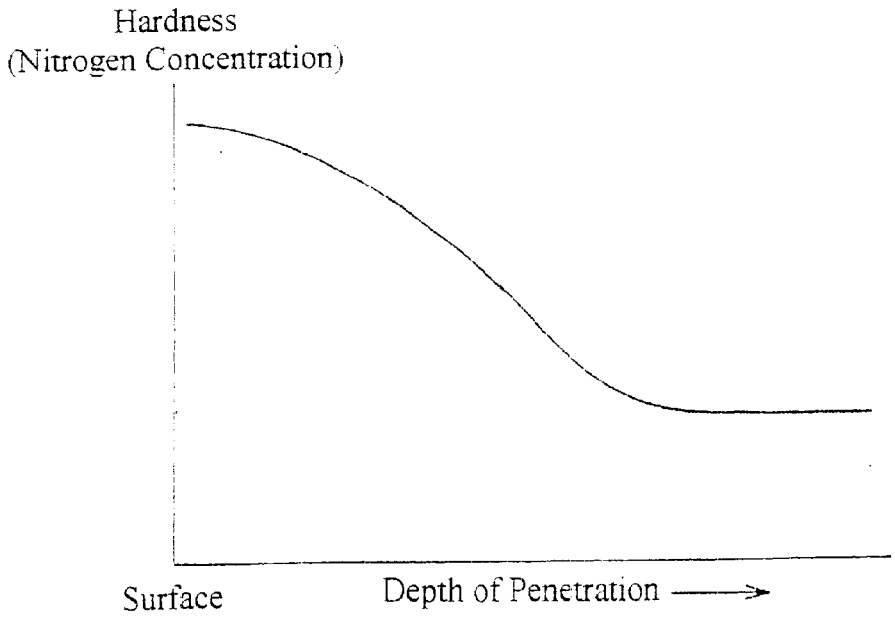
FIG. 6 is a property characteristics chart showing the hardness of the valve lifter based on nitrogen concentration in relation to the depth of the top sliding surface of the valve lifter.

Through such nitriding process shown in FIG. 5, the diffusion layer 15 and the compound layer 14 are formed in a layered manner on the base metal 16. From this nitriding process, the nitrogen (N) concentration in the diffusion layer 15 is relatively low, while the nitrogen (N) concentration in the compound layer 14 is relatively high. Since the hardness of the material increases as the nitrogen concentration increases, the hardness of the compound layer 14 is greater than that of the diffusion layer 15. Thus, the hardness of the sliding surface 12*a* decreases in the depth of penetration, since the nitrogen concentration decreases as graphically shown in FIG. 6.

However, since the original depth "$t_o$" of the compound layer 14 is very small (preferably 5 $\mu$m to 15 $\mu$m), if a conventional lapping process was performed to uniformly smoothen the top sliding surface 12*a*, then all of the compound layer 14 may be removed such that the diffusion layer 15 may be partially exposed.

Therefore, in this invention, only the outermost layer portion 14*a* of the compound layer 14 is polished, such that the portions 14*b* and 14*c* of the compound layer 14 remain. In other words, the surface of the compound layer 14 is thinly polished in a manner that conforms to the contour of the sliding surface 12*a*. Accordingly, the remaining compound layer 14 can function as a protection film having a high hardness. Accordingly, a valve lifter 12 having superior slideability and durability can be obtained at a low cost.

As the base metal 16, various steel materials can be utilized such as carbon steel, alloy steel, toll steel, and steel materials. Typically, a chromium molybdenum steel is utilized that has been carburizing, quenching, and tempering. An appropriate grinding and/or polishing process is performed beforehand on the outer surface on which the nitiriding process is to be performed.

In the preferred embodiment, the base metal 16 is preferably a forged steel (SCM420H) formed by forging, carburizing, quenching, and tempering processes that are performed such that the surface hardness is equal to or greater than 58 $H_RC$ with an effective depth is 0.7–1.1 mm. Then, a surface polishing process is performed such that the surface roughness of the outer surface is approximately Ra 0.02. Thereafter, a gas nitrocarburizing process is performed such that the surface hardness of the outer surface is equal to or greater than 660 Hv, and that the depth of the compound layer 14 is equal to or greater than 7 $\mu$m. In this manner, as shown in FIG. 3, the diffusion layer 15 and the compound layer 14 have original predetermined thicknesses that are formed on the base metal in a layered manner.

Next, as shown in FIG. 4, the buff polishing process is performed such that the surface roughness of the finished top sliding surface 12*a* is equal to or less than Ra 0.02, and that the depth "t" of the remaining compound layer 14 is preferably equal to or greater than 2.5 $\mu$m. In this buff polishing process, the polishing is performed in a manner that conforms to the contour of the top surface 12*a*, such that the compound layer 14 has a remaining or finished depth "t" of about 2.5 $\mu$m to 10 $\mu$m. Accordingly, only the outermost portion of the compound layer 14 is thinly and uniformly polished. In other words, the amount of the compound layer 14 removed by the buff polishing process is very small, approximately 3 $\mu$m to 5 $\mu$m.

In the valve lifter 12 manufactured in accordance with the present invention, the hard compound layer 14 is left on the base metal 16 to form the sliding surface 12*a*. Therefore, in comparison with a case where a hard film is separately created by PVD after the lapping process, the manufacturing cost can be reduced to approximately half, while securing the substantially same friction reduction effect and durability.

Also, by performing the buff polishing process on the top surface 12*a* of the valve lifter 12, the edges of the periphery of the top surface 12*a* are adequately rounded. Accordingly, there is no need to separately perform a chamfering process.

One of the surface processing methods that can conform to the contour of the surface is buff polishing process. The buff polishing is a surface finishing process that utilizes particles as in lapping process. However, the buff polishing utilizes a buff that is made of a cloth, felt, or leather having a soft elasticity, instead of a hard metal lap. Therefore, as described above, it is possible to thinly polish only the outermost layer portion so as to conform to the contour of the surface. Accordingly, the buff polishing process is suited for the present invention.

In other words, if the lap polishing process is performed on the aforementioned compound layer 14, although the surface can be smoothened properly, it is difficult to leave a thin uniform layer of compound layer 14. Therefore, the effects of the present invention cannot be obtained.

Referring back to FIG. 5, an $\epsilon$ phase ($Fe_2N$—$Fe_3N$) is created in the outermost layer portion 14*a* of the compound layer 14 by the nitriding process, while an $\epsilon+\gamma'$ phase and a $\gamma'$ phase are formed inside the $\epsilon$ phase by the nitriding process. The $\epsilon$ phase of the compound layer 14 has a lower toughness than the remaining layer portions 14*b* and 14*c* of the compound layer 14. Thus, the outermost layer portion 14*a* of the compound layer 14 is not preferable as the sliding surface 12*a* of the valve lifter 12. Accordingly, in the present invention, the aforesaid polishing process adequately removes this outermost layer portion 14*a*. As a result, the layer portions 14*b* and 14*c* having the $\epsilon+\gamma'$ phase and the $\gamma'$ phase are exposed. Therefore, no negative effect results from the $\epsilon$ phase that was formed by the nitriding process.

If the original depth "$t_o$" of the compound layer 14 before the polishing process is smaller than 5 $\mu$m, it is difficult to secure the thickness of the processed material layer after the polishing process. If the original depth "$t_o$" of the compound layer 14 exceeds 15 $\mu$m, a porous layer with porosity may be created. Accordingly, the original depth "$t_o$" of the compound layer 14 by the nitriding process should be preferably 5 $\mu$m to 15 $\mu$m before the polishing process.

Also, if the finished predetermined depth "t" of the compound layer 14 after the polishing process is less than 2 $\mu$m, the compound layer 14 may wear out during use. The aforesaid E phase may also be left. If the finished predetermined depth "t" of the compound layer 14 after the polishing process exceeds 10 $\mu$m, a porous layer may result at the time of creating the compound layer 14, as described above. Therefore, the finished predetermined depth "t" of the compound layer 14 after the polishing process should be preferably 2 $\mu$m to 10 $\mu$m.

If the surface roughness of the surface 12*a* of the compound layer 14 after the polishing process is less than Ra 0.01, it is difficult to perform the process on a mass-production scale. On the other hand, if the surface roughness is greater than Ra 0.05, sufficient friction reduction effect cannot be obtained. Therefore, the surface roughness of the compound layer 14 after the polishing process should be preferably Ra 0.01–0.05.

Of course, it will be apparent to those skilled in the art from this disclosure that the scope of the present invention is not limited to a valve lifter, but rather the present invention can be used with other types of sliding members. Thus, the scope of the invention is not limited to the disclosed embodiments. Some other examples of other sliding member include a shim that is slideably positioned adjacent a cam of an intake/exhaust valve, a cam follower such as a rocker arm, a piston ring, and various bearing members.

However, since the polishing is thinly performed in a manner that conforms to the contour of the surface of the sliding member in the present invention, the present invention is particularly suitable for sliding members such as cam followers. Specifically, the reduction of the surface roughness of the sliding surface, rather than the smoothness of the sliding surface is more important for cam followers. In any event, with the present invention, it is possible to provide a sliding member at a low cost that has also superior slideability and durability.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2000-286497. The entire disclosure of Japanese Patent Application No. 2000-286497 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents. Thus, the scope of the invention is not limited to the disclosed embodiments.

What is claimed is:

1. A method of manufacturing a sliding member, comprising:

creating a diffusion layer and a compound layer having predetermined depths on a base metal of the sliding member through a nitriding process; and performing a polishing process on an outermost layer portion of the compound layer to form a reduced portion of the compound layer, such that the predetermined depth of the compound layer is reduced in depth so that the reduced portion of the compound layer remains to create a smooth sliding surface on the diffusion layer on the sliding member without exposing the diffusion layer to form the smooth sliding surface.

2. The method of manufacturing as set forth in claim 1, wherein the polishing process is a buff polishing process.

3. The method of manufacturing as set forth in claim 1, wherein the sliding member is a cam follower that is slideably adjacent a cam that drives an intake valve or exhaust valve of an internal combustion engine.

4. The method of manufacturing as set forth in claim 1, wherein a depth of the compound layer before performing the polishing process is 5 $\mu$m to 15 $\mu$m.

5. The method of manufacturing as set forth in claim 1, wherein the predetermined depth of the compound layer after performing the polishing process is 2 $\mu$m to 10 $\mu$m.

6. The method of manufacturing as set forth in claim 1, wherein the smooth sliding surface of the compound layer after performing the polishing process has a surface roughness of Ra 0.01–0.05.

7. A sliding member comprising:

a base metal;

a diffusion layer with a predetermined depth overlying the base metal; and a compound layer with a second predetermined depth overlying the diffusion layer, the diffusion layer and the compound layer being formed on an outer surface of the base metal through a nitriding process, and the second predetermined depth of the compound layer being formed by a polishing process on an outermost layer portion of the compound layer such that an original depth of the compound layer formed by the nitriding process is reduced in depth to the second predetermined depth of the compound layer so that a smooth sliding surface of the compound layer remains on the diffusion layer without exposing the diffusion layer to form the smooth sliding surface.

8. The sliding member as set forth in claim 7, wherein the second predetermined depth of the compound layer formed by the polishing process has a substantially uniform depth in that the polishing process conforms to a contour of the outer surface of the base metal.

9. The sliding member as set forth in claim 7, wherein the polishing process forming the smooth sliding surface is a buff polishing process.

10. The sliding member as set forth in claim 7, wherein the sliding member is a cam follower that is slideably adjacent a cam that drives an intake valve or exhaust valve of an internal combustion engine.

11. The sliding member as set forth in claim 7, wherein the original depth of the compound layer before performing the polishing process is 5 $\mu$m to 15 $\mu$m.

12. The sliding member as set forth in claim 7, wherein the second predetermined depth of the compound layer after performing the polishing process is 2 $\mu$m to 10 $\mu$m.

13. The sliding member as set forth in claim 1, wherein the smooth sliding surface of the compound layer after performing the polishing process has a surface roughness of Ra 0.01–0.05.

* * * * *